US006199803B1

(12) United States Patent
Schafer

(10) Patent No.: US 6,199,803 B1
(45) Date of Patent: Mar. 13, 2001

(54) TRASH CONTAINER SYSTEM

(76) Inventor: Thomas C. Schafer, 813 Heritage Ave., Terrytown, LA (US) 70056

( * ) Notice: Subject to any disclaimer, the term of this patent is extended or adjusted under 35 U.S.C. 154(b) by 0 days.

(21) Appl. No.: 09/007,960

(22) Filed: Jan. 16, 1998

(51) Int. Cl.[7] ..... B65B 67/04
(52) U.S. Cl. ..... 248/99; 297/188.08; 248/100
(58) Field of Search ..... 383/42, 41, 43, 383/67, 33, 71, 75, 102, 117; 141/390, 391; 248/99, 100, 205.3, 220.21, 907, 95; 297/188.08

(56) References Cited

U.S. PATENT DOCUMENTS

| | | | | |
|---|---|---|---|---|
| D. 286,217 | | 10/1986 | Waun, et al. . | |
| D. 303,305 | | 9/1989 | Deacon . | |
| D. 341,236 | | 11/1993 | Gasca-Salas . | |
| 960,451 | | 6/1910 | Vicary . | |
| 1,965,040 | * | 7/1934 | Kelly | 209/370 |
| 2,305,863 | * | 12/1942 | Ginter | 248/100 |
| 3,779,496 | * | 12/1973 | Welles | 248/99 |
| 3,847,332 | * | 11/1974 | Murai | 248/99 |
| 3,912,208 | * | 10/1975 | Grenetier | 248/99 |
| 4,664,348 | * | 5/1987 | Corsaut, II et al. | 248/99 |
| 4,669,689 | | 6/1987 | Jones . | |
| 4,694,503 | * | 9/1987 | Hydorn | 383/12 |
| 4,705,249 | | 11/1987 | Edwards . | |
| 4,984,759 | | 1/1991 | Perlant . | |
| 5,014,944 | * | 5/1991 | Malik et al. | 248/99 |
| 5,092,682 | * | 3/1992 | Fenick | 383/22 |
| 5,201,446 | | 4/1993 | Martain . | |
| 5,268,969 | * | 12/1993 | Duran, Jr. | 383/67 |
| 5,341,933 | * | 8/1994 | Willows | 383/678 |
| 5,362,153 | | 11/1994 | Lu . | |
| 5,524,762 | | 6/1996 | Shafram et al. . | |
| 5,639,051 | | 6/1997 | Surbeck . | |
| 5,667,173 | * | 9/1997 | Wilfong, Jr. et al. | 248/100 |
| 5,927,800 | * | 7/1999 | Stallworth | 297/188.08 |

* cited by examiner

*Primary Examiner*—Anita M. King
(74) *Attorney, Agent, or Firm*—Pugh/Associates, Patent & Trademark Attorneys; C. Emmett Pugh

(57) ABSTRACT

A trash container system, particularly for marine pleasure craft, for disposing of refuse wherein the trash container system comprises a trash bag holding device having laterally projecting extensions and a trash receptacle having a resilient, elastomeric, inlet mouth at its top, couplable to the trash bag holding device about and over the lateral extensions, and a sealable (e.g. zippered), refuse expelling outlet at its bottom. The resilient elastomeric inlet mouth functions to (1) securely couple the trash receptacle to the trash bag holding device via the collapsible elastomeric properties of the resilient elastomeric inlet mouth; (2) hold refuse in the trash receptacle; and (3) expand, easily and effortlessly, to receive therethrough refuse having a myriad of dimensions and shapes. In the preferred embodiment, the body of the trash receptacle is made of mesh material with a zipper extending across its bottom to selectively discharge the contained trash (alternatively the trash can be removed though the top, if so desired) and an expandable, elastomeric opening across its top for the easy insertion of trash (or its removable, if so desired). The system was specifically designed for marine use in, for example, pleasure craft, with the trash bag holding device being secured by, for example, screws or other like mechanical fasteners or adhesive to a vertical surface (e.g. a wooden cabinet wall but can be used elsewhere as well).

20 Claims, 3 Drawing Sheets

TRASH CONTAINER SYSTEM

REFERENCE TO RELATED APPLICATION

This application is directed to the same subject matter as the design patent application entitled "Trash Container System" being filed concurrently herewith, the disclosure and drawings of which are incorporated herein by reference.

TECHNICAL FIELD

The present invention relates to trash bag systems and more particularly to a trash containment system for disposing of refuse comprising a trash bag holding device and a trash receptacle having at its top area a resilient, elastomeric inlet mouth, couplable to the trash bag holding device, and at its bottom area a sealable refuse expelling outlet. The resilient elastomeric inlet mouth functions to (1) securely couple the trash receptacle to the trash bag holding device via the collapsible elastomeric properties of the resilient elastomeric inlet mouth; (2) hold refuse in the trash receptacle; and (3) expand, easily and effortlessly, to receive therethrough refuse having a myriad of dimensions. In the preferred embodiment, the main body of the trash receptacle is made of mesh. Although useable elsewhere as well, the preferred application for the invention is in a marine environment, such as, for example, a pleasure boat.

BACKGROUND ART

While boating, soft drinks, food and snacks are consumed from time to time. In some instances, containers, wrappings, etc., are thrown on the flooring of the boat or disposed of in a plastic trash bag. However, the wind and the agitation of the boat from hitting waves can cause the trash bag and its contents to fly away if not secured in some manner to the boat. Furthermore, refuse can, on occasion, fly out of the open mouth of the trash bag or out of the boat and litter the waterway. A list of prior patents, which may be of interest, is provided below:

| PAT. NO. | Inventor | Date |
|---|---|---|
| D286,217 | Waun et al. | 10/14/1986 |
| D303,305 | Deacon | 09/05/1989 |
| D341,236 | Gasca-Salas | 11/09/1993 |
| 960,451 | Vicary | 06/07/1910 |
| 4,669,689 | Jones | 06/02/1987 |
| 4,705,249 | Edwards | 11/10/1987 |
| 4,984,759 | Perlant | 01/15/1991 |
| 5,201,446 | Martin | 04/13/1993 |
| 5,362,153 | Lu | 11/08/1994 |
| 5,524,762 | Shafram et al. | 06/11/1996 |
| 5,639,051 | Surbeck | 06/17/1997 |

Several devices have been patented which are directed to trash bag holding devices for plastic bags having hand loops wherein the trash bag holding devices are designed to attach the hand loops to the trash bag holding device for securing the plastic bags thereto, such as, described in U.S. Pat. No. 5,639,051, by Surbeck, entitled "TRASH BAG HOLDING DEVICE FOR PLASTIC GROCERY BAGS WITH LOOPED HANDLES"; U.S. Pat. No. 4,984,759, by Perlant, entitled "CONTAINER SUPPORT WITH IMPROVED BAG HOLDING MEANS"; and, U.S. Pat. No. 4,669,689, by Jones, entitled "BAG HOLDER." U.S. Des. Pat. No. 303,305, by Deacon, entitled "BAG HOLDER HOOK" illustrates an ornamental design of a bag holder hook which supports a bag from the hand loops. Most of the aforementioned trash bag holding devices, which couple thereto trash bags, stretch open the mouth of the plastic trash bag.

U.S. Des. Pat. No. 341,236, by Gasca-Salas, entitled "BAG HOLDER" and U.S. Des. Pat. No. 286,217, by Waun et al., entitled "REFUSE BAG HOLDER" illustrate an ornamental design of a bag holder wherein the bag hold maintains the mouth of the bag open.

U.S. Pat. No. 5,524,762, by Shafram et al., entitled "DISPOSABLE LITTER BAG SYSTEM" discloses a bag holder having a clip for holding a bundle of tear-off bags. Each bag of the bundle has a flap adjacent the opening of the bag wherein the clip receives such flap for holding the bundle.

U.S. Pat. No. 4,705,249, by Edwards, entitled "TRASH BAG HOLDING DEVICE" discloses a trash bag holding device which clamps to a wall of the trash bag wherein the mouth of the bag remains open.

U.S. Pat. No. 5,362,153, by Lu, entitled "LITTER BAG FOR AUTOMOBILES" discloses a litter bag for receiving therein a plastic bag. The litter bag has a zippered compartment for storing therein a roll of plastic bags. The litter bag has coupled thereto a strap which is secured under the seat of an automobile and another strap shown coupled around the support rods of a head rest. Thereby, the litter bag is supported on the back surface of the seat. The upper edges of the litter bag are resilient to maintain the mouth of the litter bag normally closed. In operation, an upper edge of the plastic bag is clipped between the upper edge of the litter bag and a side flap.

Although generally pertinent to the invention, the "resilient" upper edges of the mouth of the litter bag of Lu is quite different in structure from the resilient elastomeric inlet mouth of the trash receptacle of the present invention. More specifically, the resilient mouth of the litter bag is not disclosed as being resiliently elastomeric. Furthermore, the resilient mouth is not designed to securely couple the litter bag to a trash bag holding device via the collapsible elastomeric properties of a resilient elastomeric inlet mouth.

U.S. Pat. No. 960,451, by Vicary, entitled "BAG HOLDER" discloses a bag holder which serves to hold the mouth of the bag open by means of an adjustably held expansible bag receiving member.

U.S. Pat. No. 5,201,446, by Martin, entitled "FRUIT PICKER'S SUPPORTED CONTAINER" discloses a container supported against the user's body. The container comprises an unfolding skirt which is released via two straps for opening the bottom of the container. Thereby, the fruit in the container may be emptied from the container.

As will be seen more fully below, the present invention is substantially different in structure, methodology and approach from that of the prior art trash holding devices and trash receptacles coupled thereto.

GENERAL SUMMARY DISCUSSION OF INVENTION

The trash container system is uniquely designed to prevent refuse from littering, for example, the waterways while boating, wherein the trash container and emptying system is securable to a vertical surface of the boat and the resilient elastomeric inlet mouth of the trash receptacle of the trash container and emptying system functions to hold refuse in the trash receptacle even in the presence of high winds and the forceful agitation of the boat when the boat hits waves.

Furthermore, the trash container and emptying system of the present invention is uniquely designed to be attached to a vertical surface or near vertical surface in any environment, such as in bathrooms, closets, galley cabinets, etc.

While the trash container and emptying system of the present invention is designed for placing refuse therein, the trash container and emptying system may be used to hold therein items and containers other than refuse which are not intended to be thrown away.

More specifically, the trash container and emptying system for disposing of refuse of the present invention, comprises a trash bag holding device and a trash receptacle having a resilient elastomeric inlet, upper mouth, couplable to the trash bag holding device, and a sealable, refuse expelling outlet at its bottom area. The resilient elastomeric inlet mouth functions to (1) securely couple the trash receptacle to the trash bag holding device via the collapsible elastomeric properties of the resilient elastomeric inlet mouth; (2) hold refuse in the trash receptacle; and (3) expand to receive therethrough refuse having a myriad of dimensions and shapes. The refuse container and emptying capability of the trash container and emptying system serves to allow the trash container and emptying system to be used in environments where maintaining refuse in trash systems which maintain the mouth of the trash receptacle open has proven to be a problem.

The trash bag holding device of the trash container and emptying system preferably comprises a vertical wall support plate, a horizontal plate coupled perpendicularly to a bottom edge of the vertical wall support plate, a vertical member perpendicularly coupled to an opposite edge of the horizontal plate wherein the vertical member extends downwardly. The bottom portion of the vertical member provides first and second flanges which laterally flare from the right and left sides of the vertical member. The first and second flanges serve as holding shoulders and the portion of the vertical member above the first and second flanges serve as a fastening neck.

The trash bag holding device is constructed so as to leave clearance for coupling the top (resilient elastomeric inlet mouth) of the trash receptacle between the trash holding device and the vertical mounting surface. The resilient elastomeric inlet mouth fits over the first and second flanges projecting from the right and left sides and resiliently collapses to a predetermined, collapsed contour around the neck of the vertical member. The predetermined collapsed contour is dimensioned to allow the resilient elastomeric inlet mouth to remain coupled around the neck such that the trash receptacle is supported in a hanging position even under the weight of refuse placed therein.

In use, the resilient elastomeric inlet mouth is pulled to expand the resilient elastomeric inlet mouth from the predetermined collapsed contour to deposit refuse into the trash receptacle. Even as the resilient elastomeric inlet mouth is expanded, the resilient elastomeric properties maintain the resilient elastomeric inlet mouth secured around the neck.

In the preferred embodiment, the trash bag holding device is affixed to a vertical or near vertical surface by, for example, an adhesive substance applied to the back of the holder or other fastening system or, for further example, by mounting screws.

The preferred embodiment of the trash receptacle of the present invention comprises a back panel and a front panel having their left and right sides sewn together to form a bag-like member. The unsewn top and bottom edges of the sewn together back panel and front panel provide an inlet and an outlet, respectively.

A hem is formed along the top edge of the bag-like member for coupling therethrough a resilient elastomeric member such as, without limitation, an elastic band. The resilient elastomeric member having the predetermined collapsed contour allows the width of the inlet to be reduced to such predetermined collapsed contour for securely coupling the trash receptacle via collapsed elastomeric properties around the neck of the trash bag holding device.

Thereby, the resilient elastomeric mouth automatically (without any external forces) collapses to or toward said predetermined collapsed contour after the resilient elastomeric inlet mouth has been released. The bottom outlet of the bag-like member has attached thereto a zipper or any other type of repeatable, quick acting fastener for alternatively opening the bottom of the trash receptacle for expelling therefrom the refuse. After the refuse has been expelled from the trash receptacle via the sealable refuse expelling outlet, the sealable refuse expelling outlet is closed for further use of the trash receptacle.

In the preferred embodiment, the trash receptacle of the present invention is a mesh bag thereby allowing air to flow through and permeate into the mesh bag and allowing the contents to be visually observed. If desired, an impermeable liner, such as, for example, a preferably transparent (or opaque) plastic bag, may be placed into and folded over the top of the trash receptacle before placement on the trash bag holding device to prevent liquids from escaping.

When desired, the trash receptacle is removed from the trash bag holder and the trash receptacle rapidly emptied via the sealable refuse expelling outlet by opening the zipper at the bottom of the trash receptacle.

Alternatively, the trash receptacle can be left in place and its bottom opened for discharge of the refuse directly into, for example, a larger trash bag place beneath it for ultimate disposal. This can be particularly handy when emptying a number of trash receptacles spaced throughout a marine vessel.

The currently preferred method for disposing of refuse of the present invention comprises the following steps—providing a trash bag holding device; providing a trash receptacle for storing therein refuse having a resilient, elastomeric inlet mouth having a predetermined collapsed contour couplable to said trash bag holding device, and a sealable, refuse expelling outlet for expelling therefrom said refuse; securing the trash bag holding device to a vertical or near vertical surface; coupling said resilient, elastomeric inlet mouth to the trash bag holding device via collapsible elastomeric properties; expanding the resilient elastomeric inlet mouth; intermittently placing refuse in the trash receptacle through the upper, resilient elastomeric inlet mouth; and releasing the resilient elastomeric inlet mouth for container and emptying the contained refuse from the trash receptacle.

The method for disposing of refuse further comprises the steps of—detaching the resilient elastomeric inlet mouth from the trash bag holding device; transporting the detached trash receptacle to a (typically larger) trash container; opening the sealable, refuse expelling outlet; expelling the refuse from the trash receptacle; and re-sealing the opened, sealable, refuse expelling outlet after expelling the refuse.

The method for disposing of refuse of additionally comprises the step of—re-attaching said resilient elastomeric inlet mouth to said trash bag holding device.

The method for disposing of refuse additionally my include the use of an impermeable liner in the trash receptacle.

In summary, in the currently preferred embodiment, the body of the trash receptacle is made of mesh material with a zipper extending across its bottom to selectively discharge the contained trash (alternatively the trash can be removed though the top, if so desired) and an expandable, elastomeric opening across its top for the easy insertion of trash (or its removable, when so desired). The system was specifically designed for marine use in, for example, pleasure craft, with the trash bag holding device being secured by, for example, adhesive or screws to a vertical or near surface (e.g. a wooden cabinet wall or fiberglass or wooden wall) but the trash container system of the invention can be used elsewhere as well.

It is thus an object of the invention to provide a trash receptacle which is easily washable for cleaning away contaminates between uses or as the trash receptacle becomes soiled.

It is a further object of the invention to provide a trash receptacle which is capable of receiving therein an impermeable liner such as, for example, disposable trash bags, or other plastic bags. Alternatively, the trash receptacle is also capable of receiving therein paper bags.

It is a still further an object of the invention to provide a trash container and emptying system which can be installed in small areas.

The above and other objects and features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
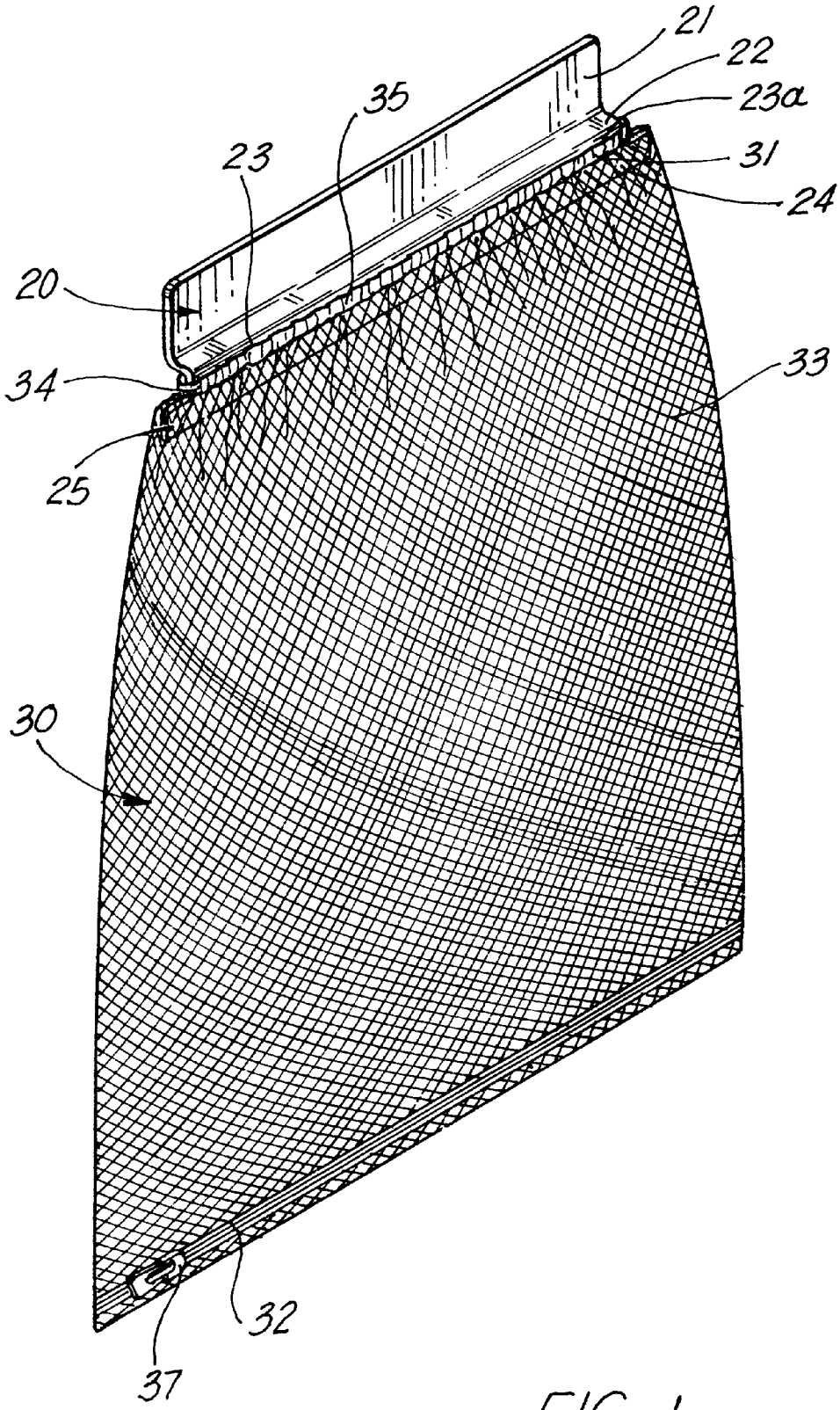
FIG. 1 is a preferred embodiment of the trash container and emptying system of the present invention.

Referring now to the drawings, and in particular FIG. 1, the trash container and emptying system of the present invention is designated generally by the numeral 10. The trash container and emptying system 10 for disposing of refuse, of the present invention, is generally comprised of a trash bag holding device 20 and a trash receptacle 30.

The trash bag holding device 20 of the trash container and emptying system 10 comprises a vertical wall support plate 21, a horizontal plate 22 coupled perpendicularly to a bottom edge of the vertical wall support plate 21, a vertical member 23 perpendicularly coupled to an opposite edge of the horizontal plate 22 wherein the vertical member 23 extends downwardly. The bottom portion of the vertical member 23 provides a first flange 24 and a second flange 25 which flare from the right and left sides, respectively, of the vertical member 23. The first and second flanges 24 and 25 serves as shoulders and the portion of the vertical member 23 above the first and second flanges 24 and 25 serves as a neck 23*a*.

Figure 2:
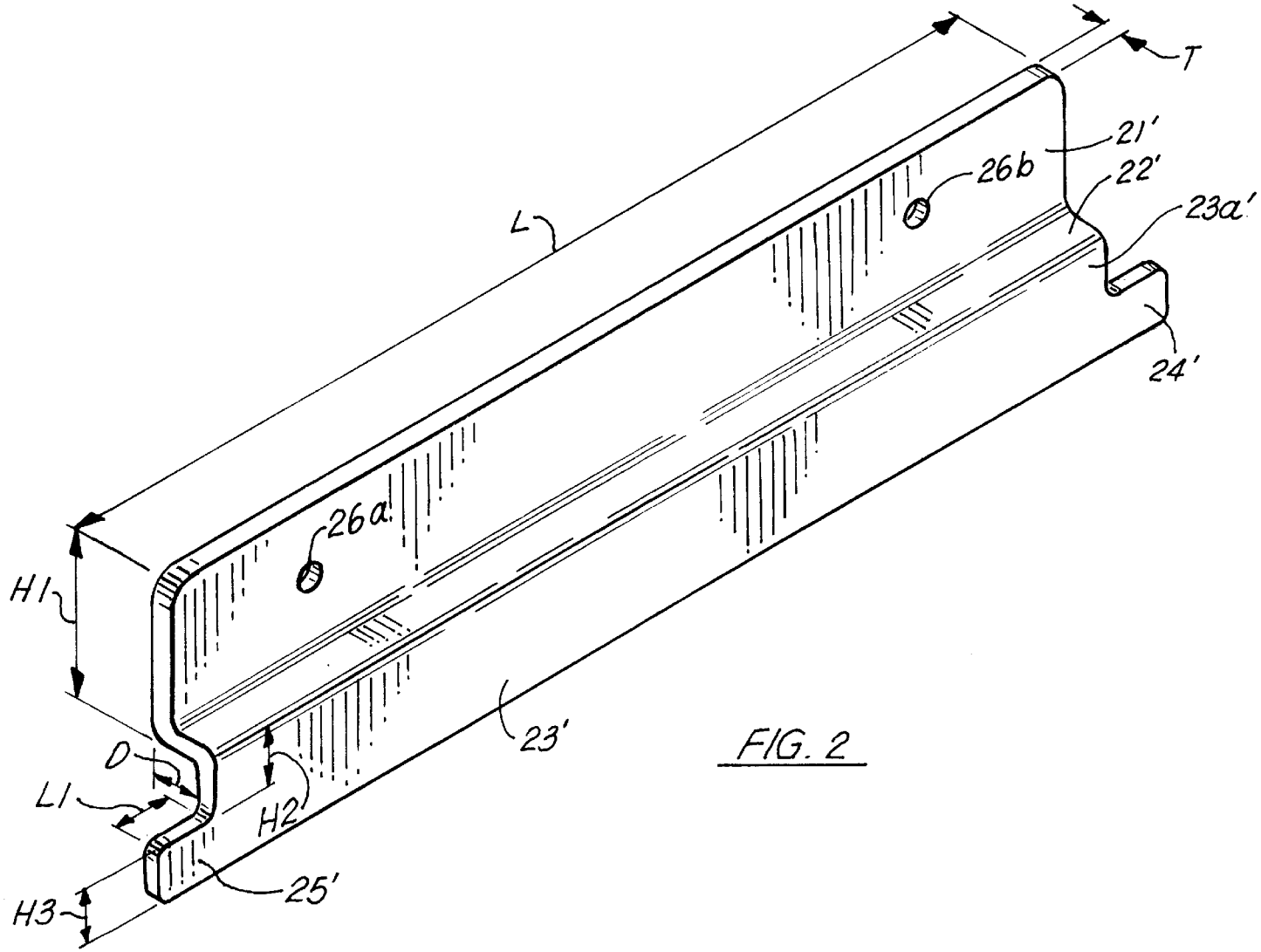
FIG. 2 is a view of an alternate embodiment of the trash bag holding device of the present invention.

The vertical wall support plate 21 is preferably secured to a vertical surface or near vertical surface via an adhesive securing member (not shown). Alternately, as shown in FIG. 2, the vertical wall support plate 21' is provided with two apertures 26*a* and 26*b* spaced apart which are capable of receiving therein other fastening members (not shown) such as, without limitation, screws, nails or hooks.

Exemplary dimensions of the trash bag holding device 20' will be described in relation to FIG. 2. The vertical wall support plate 21' can have a thickness T of, for example, approximately one eighth (⅛") of an inch, a length L of approximately nine and a half (9½") inches, and a height H1 of approximately one and a half (1½") inches. The horizontal plate 22' can have, for example, a thickness of approximately one eighth (⅛") of an inch, a length L of approximately nine and a half (9½") inches and a depth D of approximately three-eighths (⅜") of an inch.

The vertical member 23' can have a thickness of, for example, approximately one-eighth (⅛") of an inch. The neck 23*a'* of vertical member 23' can have a length L of, for example, approximately nine and a half (9½") inches, and a height H2 of approximately three-eights (⅜") of an inch. The first and second flanges 24' and 25' project a length L1 of, for example, approximately five eighths (⅝") of an inch from the right and left sides, respectively, of the vertical member 23' and a height H3 of approximately a half (½") inch. Of course, the dimensions of the trash bag holding device 20' may be modified as desired.

As can be appreciated the horizontal plate 22 and 22' distances the neck 23*a* and 23*a'* of the vertical member 23 and 23' from the vertical mounting surface. Nevertheless, the trash receptacle 30 hangs from neck 23*a* in close proximity to the vertical mounting surface.

The trash receptacle 30 is a bag-like member having a resilient, elastomeric inlet mouth 31, couplable to the trash bag holding device 20, and a sealable refuse expelling outlet 32. The bag-like member comprises a front panel 33 and a back panel (not shown, but substantially the same as the front panel) having their left and right sides sewn together. Alternatively, the front panel 33 and the back panel may be coupled or otherwise attached to side panels, if so desired, to increase the size of the bag-like member 30.

The unsewn top and bottom edges of the sewn together back panel and front panel 33 provide an inlet and an outlet. A hem 34 is formed along the top edge of the bag-like member for coupling therethrough a resilient elastomeric member 35 such as, without limitation, an elastic band.

The resilient elastomeric member 35 having the predetermined collapsed contour allows the width of the inlet to be reduced to such predetermined collapsed contour. The inlet having the resilient elastomeric member 35 serves as the resilient elastomeric inlet mouth 31 for securely coupling the trash receptacle 30 via collapsed elastomeric properties around the neck 23*a* of the trash bag holding device 20. The resilient elastomeric inlet mouth 31 automatically (without any external forces) collapses to or toward said predetermined collapsed contour of said resilient elastomeric member 35 after the resilient elastomeric inlet mouth 31 is released.

The bottom, outlet area of the bag-like member 30 has coupled or sewn or otherwise attached thereto a zipper 37, thereby forming a quick-acting, sealable, refuse expelling outlet 32. When the zipper 37 is closed, refuse remains contained in the bag-like member of the trash receptacle 30. When the zipper 37 is opened, the refuse may be easily emptied from the bag-like member of the trash receptacle 30. Nevertheless, any other type of quick closing fastener for repetitively opening the bottom (outlet) of the trash receptacle 30 for expelling therefrom the refuse may be substituted.

As can be appreciated, the refuse alternatively can be emptied from or through the top, resilient elastomeric inlet mouth 31, if so desired. However, emptying the trash receptacle 30 via the resilient elastomeric inlet mouth 31 currently is not as preferred as using the zippered, openable bottom.

In the preferred embodiment, the bag-like member of the trash receptacle 30 is made of mesh allowing air to flow through and permeate into the mesh bag-like member. Furthermore, the mesh bag-like member allows the contents to be visually observed. Nevertheless, the bag-like member may be made of other material wherein such other material is, preferably, flexible, durable and washable.

Figure 4:
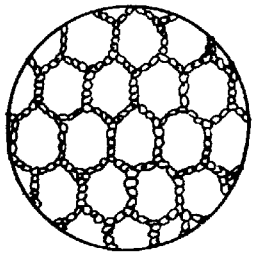
FIG. 4 is a close-up, partial view of the trash receptacle mesh bags of FIGS. 1 & 3, showing their preferred, exemplary mesh structure.

The mesh material for the bag-like member 30 can be and preferably is, for example, a woven nylon or polyester, hexagonal cell mesh having a major cell opening of approximately one eighth (⅛") of an inch vertically and three-thirty-seconds (3⁄32") of an inch horizontally. The top threads of the cells are common to the adjacent cell and the side threads are independently jointed together to the top, center and bottom of the juncture, with the other cell forming two such, smaller, vertical cells in the side wall (note FIG. 4). Such a mesh is manufactured by Militex, Inc. (Gehring Textiles, Inc., 1 West 34th St., NY, N.Y. 10001) under style "#3322."

The resilient elastomeric member 35, such as, an elastic band, serves to draw-in the inlet of the bag-like member of the trash receptacle 30 to the predetermined collapsed contour thereby decreasing the dimensions of the inlet without compromising the total storage space available in bag-like member of the trash receptacle 30.

As can be appreciated, the resilient elastomeric inlet mouth 31 functions to (1) securely couple the trash receptacle 30 to the trash bag holding device 20 via the collapsible elastomeric properties of the resilient elastomeric inlet mouth 31; (2) hold refuse in the trash receptacle 30; and (3) expand to receive therethrough refuse having a myriad of dimensions. The trash receptacle may be used to store therein other items and containers which are not meant to be thrown away.

In operation, the trash bag holding device 20 is secured to a vertical or near vertical mounting surface via the vertical wall support plate 21. The horizontal plate 22 distances the neck 23*a* of the vertical member 23 from the vertical or near vertical mounting surface thereby providing clearance for coupling the resilient elastomeric inlet mouth 31 of the trash receptacle 30 between the trash bag holding device 20 and the vertical or near vertical mounting surface. The resilient elastomeric inlet mouth 31 expands to fit over the first and second flanges 24 and 25 of the vertical member 25 and collapses to or toward its predetermined collapsed contour around the neck 23*a* of the vertical member 23.

The predetermined collapsed contour is dimensioned to allow the resilient elastomeric inlet mouth 31 to remain coupled around the neck 23*a* such that the trash receptacle 30 is supported in a hanging position in close proximity to the vertical mounting surface even under the weight of the refuse placed therein. In use, the resilient elastomeric inlet mouth 31 is pulled to expand the resilient elastomeric inlet mouth 31 from the predetermined collapsed contour to deposit refuse into the bag-like member. Even as the resilient elastomeric inlet mouth 31 is expanded, the resilient elastomeric properties maintain the resilient elastomeric inlet mouth 31 secured around the neck 23*a*.

When desired, the trash receptacle 30 is removed from the trash bag holding device 20 and the trash receptacle 30 rapidly emptied by opening the sealable refuse expelling outlet 32 by unzipping the zipper 37. After the contents in the trash receptacle 30 has been emptied the zipper 37 is zipped to seal sealable refuse expelling outlet 32.

Figure 3:
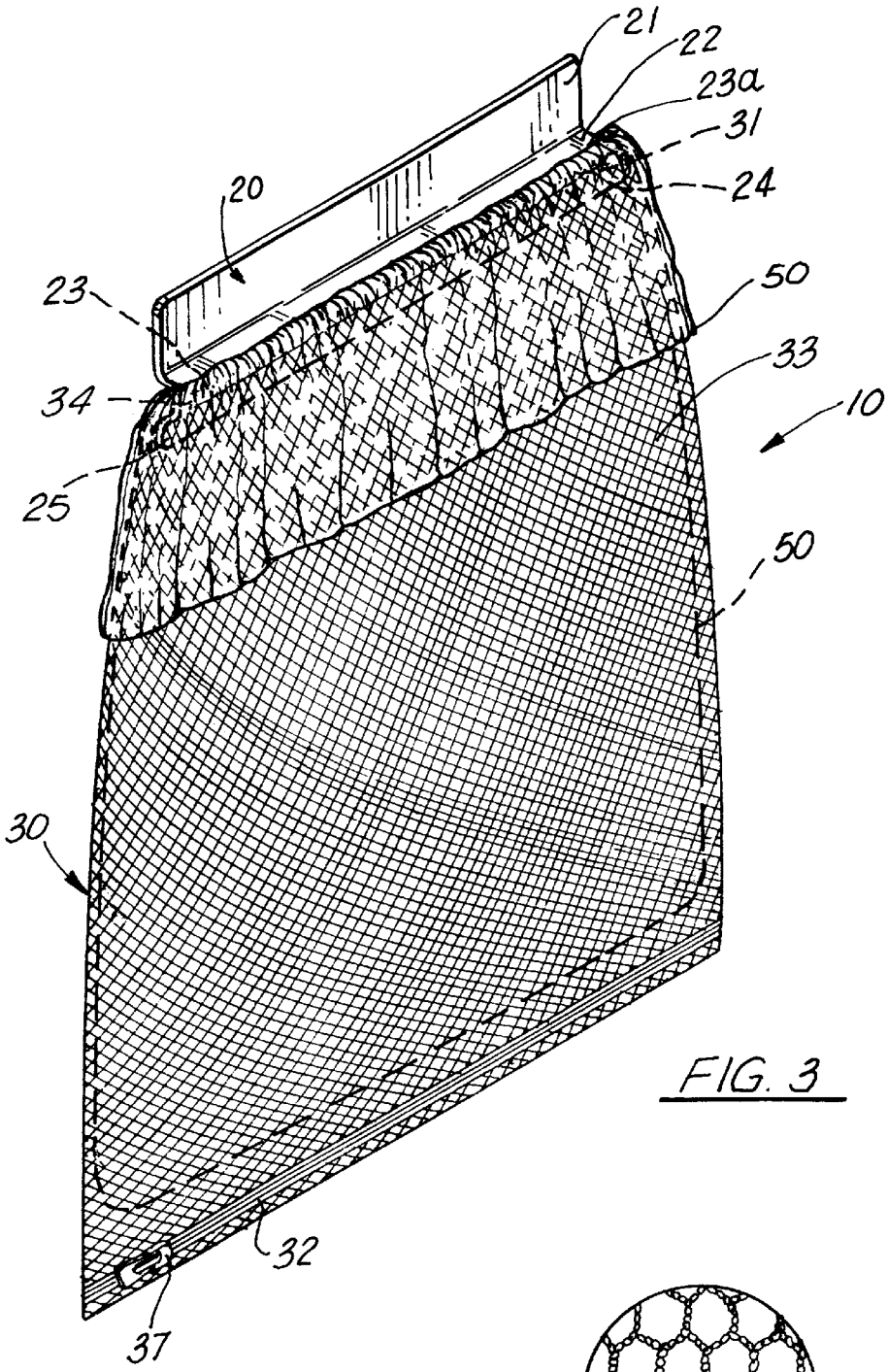
FIG. 3 is a view of the preferred embodiment of the trash container and emptying system of the present invention having an impermeable liner placed into the trash receptacle.

Referring now to FIG. 3, an impermeable liner such as a plastic bag 50 ay be placed into and folded over the top of the resilient elastomeric inlet mouth 31 before placement of the trash receptacle 30 on the trash bag holding device 20 to prevent liquids from escaping. When expelling the contents of the plastic bag, the sealable refuse expelling outlet 32 is opened and the plastic bag 50 and the contents therein are removed. The plastic bag 50 and the contents may then be disposed of in a conventional manner.

As can be readily seen, the method for disposing of refuse, of the present invention comprises the following steps: providing the trash bag holding device 20; providing the trash receptacle 30 for storing therein refuse having a resilient elastomeric inlet mouth 31 having a predetermined collapsed contour couplable to the trash bag holding device 20, and a sealable refuse expelling outlet 32 for expelling therefrom the refuse; securing the trash bag holding device 20 to a vertical or near vertical surface; coupling the resilient elastomeric inlet mouth 31 to the trash bag holding device 20 using the collapsible elastomeric properties; expanding the resilient elastomeric inlet mouth 31; intermittently placing refuse in the trash receptacle 30 through the upper, resilient, elastomeric inlet mouth 31; and, if so desired, releasing the resilient elastomeric inlet mouth 31 and emptying the refuse from the trash receptacle 30 using preferably the bottom, zippered outlet or, alternatively, the upper, elastomeric mouth. The former does require the removable of the trash receptacle bag 30 from the holding device 20, while the latter typically would.

The method for disposing of refuse may further comprise the steps of—detaching the resilient elastomeric inlet mouth 31 from the trash bag holding device 20; transporting the detached trash receptacle bag 30 to a trash container (not shown); opening the sealable refuse expelling outlet 32; expelling the refuse from the trash receptacle 30; and re-sealing the opened, sealable refuse expelling outlet 32 after expelling the refuse.

Since the trash receptacle 30 of the container and emptying trash system 10 of the present is cleanable and reusable, the method for disposing of refuse of additionally comprises the step of—re-attaching the resilient elastomeric inlet mouth 31 to the trash bag holding device 20 for further use as a trash receptacle.

The method for disposing of refuse additionally may include the use of an impermeable liner such as, for example, a plastic bag 50 (note FIG. 3) within the interior of the trash receptacle 30. When the plastic bag 50 is placed in the trash receptacle 30, the mouth of the plastic bag 50 preferably is folded over the resilient, elastomeric inlet mouth 31. The resilient elastomeric inlet mouth 31 maintains the plastic bag 50 in place when the mouth of the plastic bag 50 is collapsed to the predetermined collapsed contour of the resilient elastomeric inlet mouth 31.

As the resilient elastomeric inlet mouth 31 is expanded to pass therethrough the refuse, the mouth of the plastic bag 50 is expanded accordingly. When the resilient elastomeric inlet mouth 31 is released, the resilient elastomeric inlet mouth 31 and the plastic bag 50 collapse to or toward the predetermined collapsed contour of the resilient elastomeric inlet mouth 31 via the collapsible elastomeric properties of the resilient elastomeric inlet mouth 31.

It is noted that the embodiment(s) described herein in detail for exemplary purposes is of course subject to many different variations in structure, design, application and methodology. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A trash container and emptying system for disposing of refuse, comprising:

a trash bag holding device securable to a vertical or near vertical surface, having an at least generally flat, surface securement portion and a trash receptacle bag holding portion with laterally extending, side ends generally forming a "T" shape; and an associated trash receptacle bag for storing therein refuse having a bottom and a top, a resilient, elastomeric, inlet mouth at the bag's top having a predetermined collapsed contour couplable to said trash bag holding device by being extendable over, above and about said laterally extending, side ends and then inherently moving inwardly above and past said side ends under its elastomeric properties, a proximal side and a distal side, with the distal side being closer to said surface securement portion of said bag holding device when said trash receptacle bag is coupled to said bag holding device, and a sealable refuse discharging outlet located at said bottom of said trash receptacle bag for discharging therefrom the refuse;

said trash receptacle bag hanging down from said holding device when said resilient, elastomeric, inlet mouth is coupled to said trash bag holding device above and about said laterally extending, side ends, allowing trash to be inserted into said bag when the user inserts refuse through said inlet mouth by moving said proximal side of said inlet mouth orthogonally away from said bag holding portion of said bag holding device, while allowing said trash bag to be easily remove from said trash bag holding device by stretching said inlet mouth sideways past and away from the ends of said laterally extending, side ends.

2. The trash container and emptying system of claim 1, wherein:

said resilient, elastomeric, inlet mouth serves to (1) securely couple said trash receptacle bag to said trash bag holding device via the collapsible elastomeric properties of said resilient, elastomeric, inlet mouth; (2) hold the refuse in said trash receptacle bag generally preventing any inserted refuse from coming out of the collapsed inlet mouth; and (3) orthogonally expand to receive there through the refuse.

3. The trash container and emptying system of claim 1, wherein said trash bag holding device further comprises:

a flat, wall support plate section securable to the vertical or near vertical surface, forming said surface securement portion; and an intermediate portion having a first edge and an opposite edge, with said first edge connected to said wall support plate section; said laterally extending, side ends being attached to said intermediate portion and spaced outwardly from said flat, wall support plate section.

4. The trash container and emptying system of claim 3, wherein:

said intermediate portion forms a neck; and said resilient, elastomeric, inlet mouth is couplable to said neck via said inlet mouth's collapsed, elastomeric properties collapsing around said neck.

5. The trash container and emptying system of claim 4, wherein said support plate section is attached to a support surface, and wherein:

said intermediate portion extends out from said support plate section, providing clearance for said resilient, elastomeric, inlet mouth between said support surface section and said laterally extended, side ends.

6. The trash container and emptying system of claim 5, wherein:

said surface securement portion is secured to the support surface via an adhesive.

7. The trash container and emptying system of claim 5, wherein:

said surface securement portion and said bag holding portion are both flat and lie in two, spaced, parallel planes, with said intermediate portion lying in a different plane than either of said two, spaced, parallel planes and being connected between said surface securement portion and said bag holding portion.

8. The trash container and emptying system of claim 5, wherein:

said surface securement portion, said intermediate portion and said bag holding portion are made of plastic in one, integral piece.

9. The trash container and emptying system of claim 8, wherein there is further included:

a plastic bag associated with and insertable within said trash receptacle bag.

10. The trash container and emptying system of claim 1, wherein said trash receptacle bag, comprises:

a back panel forming said distal side;

a front panel forming said proximal side secured to said back panel forming a top inlet and a bottom outlet;

a hem formed along a top edge of said trash receptacle bag;

a resilient, elastomeric member associated with said inlet and having said predetermined collapsed contour causing the width of the inlet mouth to be reduced to such predetermined collapsed contour forming said resilient, elastomeric, inlet mouth; and a fastening member associated with said bottom outlet, allowing the bottom outlet to be alternately opened and fastened closed forming said sealable, refuse discharging outlet.

11. The trash container and emptying system of claim 10, wherein:

said fastening member is a quick-closing, zipper fastener used for alternatively opening and closing off said refuse discharging outlet.

12. The trash container and emptying system of claim 1, wherein:

said trash receptacle bag is a made of mesh material.

13. The trash container and emptying system of claim 1, wherein there is further included:

a plastic bag having an open top and a bottom associated with and insertable within said trash receptacle bag with said open top of the plastic bag being positionable in juxtaposition to said inlet mouth of said trash receptacle bag, while said bottom of said plastic bag is concurrently positionable in juxtaposition to the bottom of said trash receptacle bag.

14. A method for disposing of refuse, comprising the steps of:

(a) providing a trash bag holding device for a vertical or near vertical surface having an at least generally flat, surface securement portion and a trash receptacle bag holding portion with laterally extending, side ends generally forming a "T" shape;

(b) providing a trash receptacle bag having a top and a bottom with an open interior without any interior restrictions between the top and bottom of the bag for storing therein refuse, having a resilient, elastomeric, inlet mouth having a predetermined collapsed contour couplable to the trash bag holding device about the "T" shape, and a refuse discharging outlet for discharging therefrom the refuse manually placed in the trash receptacle bag;

(c) securing the trash bag holding device to a vertical or near vertical surface using the generally flat surface securement portion of the trash bag holding device;

(d) coupling the resilient, elastomeric, inlet mouth to the trash bag holding device about the "T" shape via the resilient, collapsible elastomeric properties of the inlet mouth, suspending the bag from and holding the bag in place on the bag holding device solely by the elastic interaction of the collapsed inlet mouth about the "T" shape with the elastomeric, inlet mouth having been extended by the user over, above and about the side ends of the bag holding device and allowed to collapse elastically about the "T" shape;

(e) intermittently expanding out the resilient, elastomeric inlet mouth in an orthogonally outward direction away from the vertical surface to which the bag holding device is secured while the bag is coupled to and solely held by the "T" shape of the bag holding device;

(f) manually placing refuse in the trash receptacle bag through the orthogonally outwardly expanded, resilient, elastomeric, inlet mouth while step "e" is being performed;

(g) promptly after the refuse has been placed in the bag in step "f", releasing the resilient elastomeric inlet mouth, allowing it to return to the mouth's collapsed disposition, returning the bag to being solely held by the "T" shape of the bag holding device; and (h) sometime thereafter, emptying the manually placed refuse in the trash receptacle bag through the refuse discharging outlet for disposal of the refuse.

15. The method for disposing of refuse of claim 14, wherein the bag has a bottom and includes a sealable refuse discharging outlet at the bag's bottom, further comprising in connection with step "h" the steps of:

detaching the resilient, elastomeric, inlet mouth from the trash bag holding device by expanding out the elastomeric, inlet mouth of the bag laterally out away from the side edges of the "T" shape, decoupling the bag from the "T" shape;

transporting the detached trash receptacle bag to a trash container;

opening the sealable refuse discharging outlet;

discharging the refuse from the trash receptacle bag through the open refuse discharging outlet; and re-sealing the opened, sealable refuse discharging outlet after discharging the refuse.

16. The method for disposing of refuse of claim 15, further comprising the step of:

re-coupling the resilient, elastomeric, inlet mouth to about the "T" shape of the trash bag holding device.

17. The method for disposing of refuse of claim 14, further comprising the steps of:

inserting an impermeable, liner bag into the trash receptacle bag; and placing refuse in the liner bag in the trash receptacle bag through the resilient, elastomeric, inlet mouth.

18. The method for disposing of refuse of claim 17, wherein the bag has a bottom and includes a sealable refuse discharging outlet at the bag's bottom, further comprising the steps of:

opening the sealable refuse discharging outlet;

discharging the refuse, including the liner bag, through the opened sealable refuse discharging outlet at the bottom of the bag; and re-sealing the sealable refuse discharging outlet.

19. The method for disposing of refuse of claim 18, wherein the sealable refuse discharging outlet includes a zipper, further comprising the steps of:

opening the sealable refuse discharging outlet by un-zipping the zipper; and re-sealing the sealable refuse discharging outlet by zipping the zipper closed.

20. The method for disposing of refuse of claim 10, wherein the bag has a bottom and includes a sealable refuse discharging outlet at the bag's bottom, further comprising in connection with step "h" the steps of:

opening the sealable refuse discharging outlet;

discharging the manually placed refuse, for the disposal of the manually placed refuse, from the trash receptacle bag through the open refuse discharging outlet while the bag is coupled to the trash bag holding device; and re-sealing the opened, sealable refuse discharging outlet after discharging the refuse to then be able to receive and hold additional refuse for later disposal.

* * * * *